US005632219A

United States Patent [19]

Fleming, Jr.

[11] Patent Number: 5,632,219

[45] Date of Patent: May 27, 1997

[54] WATERSKI TOW ROPE RETRIEVER

[76] Inventor: David S. Fleming, Jr., 1509 Beicher Rd., Garner, N.C. 27529

[21] Appl. No.: 587,807

[22] Filed: Jan. 3, 1996

[51] Int. Cl.[6] ..... B63B 21/16

[52] U.S. Cl. ..... 114/254

[58] Field of Search ..... 114/253, 254; 242/615, 570, 590, 600, 398, 388, 397, 370

[56] References Cited

U.S. PATENT DOCUMENTS

| | | | |
|---|---|---|---|
| 2,816,310 | 12/1957 | Nale | 114/254 |
| 2,915,259 | 12/1959 | Force | 114/254 |
| 2,956,778 | 10/1960 | Weide et al. | 114/254 |
| 3,003,453 | 10/1961 | Jamieson | 114/254 |
| 3,034,742 | 5/1962 | Reynolds | 114/254 |
| 3,043,259 | 7/1962 | Sadler | 114/254 |
| 3,195,831 | 7/1965 | Shriner et al. | 114/254 |
| 3,420,466 | 1/1969 | Sanders | 114/254 |
| 3,919,963 | 11/1975 | Cox, III | 114/235 |
| 4,393,803 | 7/1983 | Donalies | 114/254 |
| 5,469,947 | 11/1995 | Anzai et al. | 192/21.5 |

*Primary Examiner*—Stephen Avila
*Attorney, Agent, or Firm*—David E. Bennett; Rhodes, Coats & Bennett, L.L.P.

[57] ABSTRACT

A multiple-spool waterski tow rope retriever for reeling in a plurality of waterski tow ropes either together or independently. The device may include a housing for outboard mounting on the back of a ski boat, or it may be mounted inboard whereby the tow ropes would extend through holes in the transom of the boat. A motor drives a driveshaft inside a plurality of tow rope spools. The motor may drive the shaft directly or indirectly via a gear, chain, or belt apparatus. The driveshaft transfers rotational power to each spool through a fluid drive apparatus. For each spool, a sleeve is immovably mounted around the shaft within the center section of the spool. The spools rotate around the sleeve and shaft on bearings and are held in place longitudinally by thrust washers. A sealed void surrounding the sleeve within the center of the spool is filled with a high viscosity oil or other high viscosity fluid. When the shaft rotates at high RPM's, the high viscosity oil transfers the rotational force to the spool. Only enough force is transferred to the spool to reel in an unattended tow rope, not a water-skier; therefore, only the spool or spools that are not towing skiers will be turned. This prevents unattended ropes from trailing behind the boat when a skier is still skiing. A locking device may also be included to lock one or all of the spools in place to allow less than a full length of a tow rope to be used by a waterskier. When the motor is not rotating, very minimal effort is required to unreel the tow rope from its spool, thereby enabling easy use by beginning waterskiers.

20 Claims, 5 Drawing Sheets

WATERSKI TOW ROPE RETRIEVER

FIELD OF THE INVENTION

The present invention generally relates to apparatuses for winding and storing waterski tow ropes on motorized spools and more particularly relates to a multiple-spool waterski tow rope retriever that can individually reel in only an unattended tow rope while leaving out a tow rope being used by a waterskier.

BACKGROUND OF THE INVENTION

Many apparatuses have been developed for storing, letting out, and reeling in waterski tow ropes by providing motorized reels that are mounted either inboard or outboard on the back of a waterski boat. Several such tow rope reel apparatuses are disclosed in the following patents: U.S. Pat. No. 3,919,963 to Cox, III; U.S. Pat. No. 3,420,466 to Sanders; U.S. Pat. No. 3,034,742 to Reynolds; U.S. Pat. No. 2,915,259 to Force; and U.S. Pat. No. 2,816,310 to Nale. However, the apparatuses disclosed in these patents are disadvantageous because they only provide a single tow rope for a single waterskier.

This disadvantage has been overcome by the development of several tow rope reel apparatuses that include more than one spool, accordingly providing more than one tow rope, so that a number of waterskiers can ski behind the same boat simultaneously. For example, U.S. Pat. No. 3,195,831 to Shriner et al.; U.S. Pat. No. 3,043,259 to Sadler; and U.S. Pat. No. 3,003,453 to Jamieson all disclose waterski tow rope reel apparatuses that have multiple spools with multiple tow ropes. However, a circumstance that must be taken into consideration when more than one waterskier is towed behind a single boat is the danger created when one skier falls or lets go of his/her rope while the other skier remains up. The tow rope that has been dropped can pose a hazard to the skier who remains up and continues to ski. Therefore, it is desirable to provide a means for reeling in the tow ropes independently of one another so that an unattended tow rope can be removed from the path of a skier who is still skiing.

The patent to Sadler discloses one method of providing tow rope independence, which is to simply provide two independently operating tow rope reel apparatuses, each having its own motor, driveshaft, and spool. Each tow rope reel apparatus disclosed in the Sadler patent also includes a solenoid-operated mechanical linkage that engages and disengages the spool from the driveshaft using male and female spline gears. This method of providing tow rope independence is disadvantageous, however, because many components such as the motor are redundant. Two entirely independent reel apparatuses, one for each tow rope and skier, add weight and bulk to the waterski boat and are more costly than necessary.

The approach taken by Shriner et al. and Jamieson is more efficient than that of Sadler. As disclosed in the Shriner et al. and Jamieson patents, a single motor is used to drive multiple spools. However, if only one motor is used to reel in both tow ropes, the multiple spools must still be independently operative so that the aforementioned danger of waterskiing alongside an unattended tow rope trailing behind the boat is avoided. The apparatus disclosed in the patent to Shriner et al. retrieves two waterski tow ropes either simultaneously or independently of each other by using differential gearing.

The patent to Jamieson discloses a ski rope reel apparatus that includes a single motor, a single driveshaft, and three spools. This apparatus automatically retrieves any unattended ropes and can retrieve ropes simultaneously or independently of each other by employing a "friction clutch" for each spool so that the spools can rotate independently of each other. Each friction clutch consists of a pair of opposing semi-circular shoes, one of which is attached to the respective spool, that frictionally embrace the driveshaft to transfer force from the driveshaft to the respective spool. In the operation of the Jamieson apparatus, from one to three waterskiers can pull the tow ropes from the spools, which slip on the friction clutches as they are unreeled due to the pull exerted by the skiers. The ski boat to which the apparatus is attached will then taxi away until the full lengths of the tow ropes are let out from the spools. If one or all of the waterskiers falls or lets go of his/her tow rope, the boat operator can actuate the motor to rewind the unattended tow ropes onto the spools. However, if one or two skiers remain up and continue to ski, tension on these attended tow ropes prevents them from being reeled in. The driveshaft will slip within the friction clutch shoes associated with these spools and the spools still trailing skiers will not rotate; only the spools with unattended tow ropes will rotate.

While the Jamieson apparatus is advantageous in that it permits a number of waterskiers to ski behind the same boat simultaneously and in that it independently reels in the tow ropes, the configuration of this apparatus has several disadvantages. First, the friction clutches employ shoes that tend to wear out over time, much like automotive brake shoes or clutch disks. The clutch shoes on the Jamieson apparatus must therefore be periodically replaced for the Jamieson apparatus to function properly and safely. Worn clutch shoes could result in unattended tow ropes not being reeled in or being reeled in too slowly, posing the aforementioned hazards to other skiers. A second disadvantage of the Jamieson design is that because the friction clutches require just that, friction, wet clutch shoes tend to impair the functioning of the friction clutches. Because the tow rope apparatus is used on a waterski boat and is constantly doused with water, the friction clutches will inevitably become wet and lose their effectiveness similarly to wet brake shoes on a car. Like worn clutch shoes, wet clutch shoes can result in the dangerous situation of unattended tow ropes not being reeled in, or at least being reeled in too slowly. A third disadvantage is that the friction clutches add considerable bulk and length to the Jamieson apparatus. The friction clutches are disposed beside the respective spools around the driveshaft; therefore, the spools must be separated by some distance and cannot be disposed side-by-side immediately adjacent to one another to give rise to a compact configuration. A fourth disadvantage is that a certain threshold amount of pull must be exerted on the tow rope of each spool to overcome the friction clutch, breaking its grip on the driveshaft, and unwind the tow rope from the spool. This presents problems for beginning waterskiers who must concentrate both on standing up in the water while simultaneously pulling on the tow rope. Beginning waterskiers learn more quickly if they only have to worry about one thing at a time; therefore, the friction clutches disclosed in the prior art complicate the learning process for beginning skiers.

Another waterski tow rope reel apparatus that employs a friction clutch is disclosed in U.S. Pat. No. 2,956,778 to Weide. This patent discloses an apparatus that includes only one spool with an adjustable friction clutch mechanism for transferring power from a driveshaft to the spool. The friction clutch mechanism includes a number of friction discs and plates that cooperate with each other to turn the spool. A washer-nut is hand tightened to adjust the amount of slip in the clutch to thereby vary the power transferred to the spool. However, this apparatus is disadvantageous not only because it can be used by only one waterskier but also because it is subject to the same problems with friction surface wear and wetness detailed above with regard to the Jamieson apparatus.

Thus, there remains a need for a new and improved waterski tow rope reel apparatus that can be used to tow more than one waterskier simultaneously while at the same time being able to independently reel in only an unattended tow rope while leaving out a tow rope being used by a waterskier.

OBJECTS AND SUMMARY OF THE INVENTION

In view of the above, an object of the present invention is to provide a waterski tow rope retriever that includes multiple tow rope spools so that multiple waterskiers can be towed behind the same ski boat simultaneously.

Another object of the present invention is to provide a waterski tow rope retriever having multiple tow rope spools, wherein each spool can be independently turned so that unattended or dropped tow ropes can be reeled in while attended tow ropes can remain let out behind the boat.

A further object of the present invention is to provide a multiple-spool waterski tow rope retriever that includes a drive means that overcomes the problems associated with previously employed friction clutches in that it is unaffected by water and friction surface wear.

A particular object of the present invention is to provide a multiple-spool waterski tow rope retriever that includes fluid drive means for transferring rotational force from a driveshaft to the tow rope spools through a relatively high viscosity fluid.

A further object of the present invention is to provide a multiple-spool waterski tow rope retriever, wherein each tow rope spool includes its own internal fluid drive.

Still another object of the present invention is to provide a waterski tow rope retriever having multiple tow rope spools that are disposed immediately adjacent to one another to provide a compact configuration.

Yet another object of the present invention is to provide a multiple-spool waterski tow rope retriever that includes a spool locking device associated with each spool to allow less than full lengths of tow ropes to be let out.

An additional object of the present invention is to provide a waterski tow rope retriever having at least one spool, wherein the spool can effortlessly be unwound to let out the attached tow rope so that a beginning waterskier does not have to simultaneously concentrate on standing up and exerting pull on the tow rope to unwind it from a spool having a friction clutch, thereby reducing the complexity of learning to waterski.

In one aspect, the present invention achieves these and other objects by providing a waterski tow rope retriever that includes: (a) a frame for attachment to a rear section of a waterski boat; (b) a driveshaft rotatably mounted in the frame; (c) a motor operatively connected to the driveshaft; (d) at least one spool for storing, letting out, and reeling in a waterski tow rope attached to each spool; and (e) a fluid drive associated with the at least one spool for transferring rotational power from the driveshaft to the at least one spool.

In the preferred embodiment, the waterski tow rope retriever includes a plurality of spools, each spool having an attached waterski tow rope so that multiple waterskiers can be towed behind the waterski boat. To create a compact configuration, the plurality of spools are disposed side-by-side around the driveshaft immediately adjacent to one another. The waterski tow rope retriever may be mounted on the boat either inboard or outboard. If mounted outboard, the invention preferably includes a housing that encloses the spools, the housing including a plurality of waterski tow rope guide ports through which pass the waterski ropes.

To allow less than full lengths of waterski tow rope to be let out to tow waterskiers, the waterski tow rope retriever of the invention preferably includes a spool locking device associated with each spool, the spool locking device operative to engage respective spools to prevent the spools from rotating. The spool locking devices may be operative all together as one unit or may be individually operative so that the waterski tow ropes can each be individually let out to any desired lengths.

The motor is preferably selectively operative to rotate the driveshaft at variable speeds. In the preferred embodiment, the driveshaft is unidirectional, rotating only in a direction that reels in the tow rope. Therefore, the waterski tow rope retriever includes an anti-reverse mechanism associated with the driveshaft, the anti-reverse mechanism preferably including: a collar attached to the frame, the collar including a primary void in which is disposed the driveshaft and a secondary void communicating with the primary void; and an anti-reverse roller disposed in the secondary void, the anti-reverse roller selectively engaging the driveshaft to permit rotation of the driveshaft in only one direction.

In another aspect, the present invention achieves the above-stated and other objects by providing a waterski tow rope spool for a waterski tow rope retriever that includes a frame for attachment to a waterski boat and a motor-driven driveshaft rotatably mounted in the frame for rotating the waterski tow rope spool, the waterski tow rope spool including: (a) a central cylinder to which a waterski tow rope is anchored, the driveshaft extending longitudinally through the cylinder; (b) a pair of flanges extending outwardly from opposite ends of the central cylinder, the flanges forming lateral barriers to maintain the waterski tow rope on the spool; and (c) a fluid drive for transferring rotational force from the driveshaft to the spool, the fluid drive including a sealed internal void within the central cylinder surrounding the driveshaft and a volume of fluid disposed within the internal void, the fluid of sufficiently high viscosity to transfer rotational force from the driveshaft to the spool.

When the driveshaft rotates, the fluid drive causes the spool to rotate with only enough force to reel in the waterski tow rope after it has been released by a waterskier. However, when a waterskier wishes to unreel the tow rope from the spool, the fluid drive permits the spool to rotate independently of the driveshaft and thereby let out the tow rope. When the driveshaft is not rotating, almost no effort is required to unreel the tow rope from the spool. Preferably, all components of the spool are disposed between two planes defined by outer surfaces of the two flanges, thereby allowing a plurality of like spools to be disposed on the driveshaft immediately adjacent to one another.

Preferably, the fluid comprises high viscosity oil although other fluids could be used instead. To prevent the high-viscosity fluid from leaking out of the internal void, the waterski tow rope spool preferably includes a sealing assembly at each end of the spool around the driveshaft. Each sealing assembly includes a bearing around the driveshaft for reducing friction and an annular seal adjacent the bearing. A pair of thrust washers disposed around the driveshaft prevents longitudinal movement of the spool relative to the driveshaft in either direction. The fluid drive of the waterski tow rope spool also preferably includes a sleeve immovably disposed around the driveshaft within the internal void within the central cylinder.

The central cylinder of the waterski tow rope spool includes at least one access opening into the internal void for filling and emptying the internal void with the fluid, each access opening including an associated plug for closing the respective access opening. Preferably, there are two access openings in the central cylinder, which are disposed on opposite ends and opposite sides of the central cylinder from one another to enable thorough bleeding of air bubbles from the clutch fluid.

In the preferred embodiment, the waterski tow rope spool includes a locking structure to allow less than full lengths of waterski tow rope to be let out to tow waterskiers. The locking structure preferably includes a locking solenoid associated with the spool, the locking solenoid including a locking pin that is operative to extend into a hole in one of the spool flanges to thereby prevent the spool from rotating. The hole is disposed in a spool flange with a relatively wide outer edge, the hole extending into the respective flange from the relatively wide outer edge.

In yet another aspect, the present invention achieves the above-stated and other objects by providing a multiple waterski tow rope retriever, comprising: (a) a frame for attachment to a rear section of a waterski boat; (b) a driveshaft rotatably mounted in the frame; (c) a motor operatively connected to the driveshaft for rotating the driveshaft; (d) a plurality of spools disposed around the driveshaft immediately adjacent to one another for storing, letting out, and reeling in multiple waterski tow ropes, each tow rope attached to one of the spools, each spool including: a central cylinder to which one of the waterski tow ropes is anchored, the driveshaft extending longitudinally through the cylinder, and a pair of flanges extending outwardly from opposite ends of the central cylinder, the flanges forming lateral barriers to maintain the waterski tow rope on the spool; and (e) fluid drive means associated with the spools for transferring rotational force from the driveshaft to the spools, the fluid drive means including: an internal void within each central cylinder surrounding the driveshaft, a sleeve within each internal void immovably disposed around the driveshaft, sealing means for sealingly enclosing the internal void within each central cylinder, and a relatively high viscosity fluid disposed within the internal void within each central cylinder.

When the driveshaft rotates, the fluid drive means causes the spools to rotate with only enough force to reel in the waterski tow ropes after they have been released by waterskiers. However, when a waterskier wishes to unreel a waterski rope from a respective one of the spools, the fluid drive means permits the respective spool to rotate independently of the driveshaft and the other spools and thereby let out the respective waterski rope. Beginning waterskiers find that the present invention simplifies learning to waterski because almost no effort is required to unwind the tow rope from each spool. Unlike the friction clutches in the prior art tow rope reel apparatuses, the fluid drive means in the spools of the present invention do not have to be overpowered with a threshold level of pull to break the grip of the friction clutch.

Preferably, at least one of the flanges of each spool includes a relatively wide outer edge with a hole extending into the respective flange from the relatively wide outer edge. The multiple waterski tow rope retriever further comprises a plurality of spool locking solenoids attached to the frame, one spool locking solenoid associated with each spool. The spool locking solenoids are operative to engage respective spools to prevent the respective spools from rotating, thereby allowing less than full lengths of waterski tow rope to be let out from the respective spools to tow waterskiers.

Other aspects and advantages of the present invention will become apparent and obvious from a study of the following description and the accompanying drawings, which are merely illustrative of the invention.

DETAILED DESCRIPTION OF THE INVENTION

Figure 1:
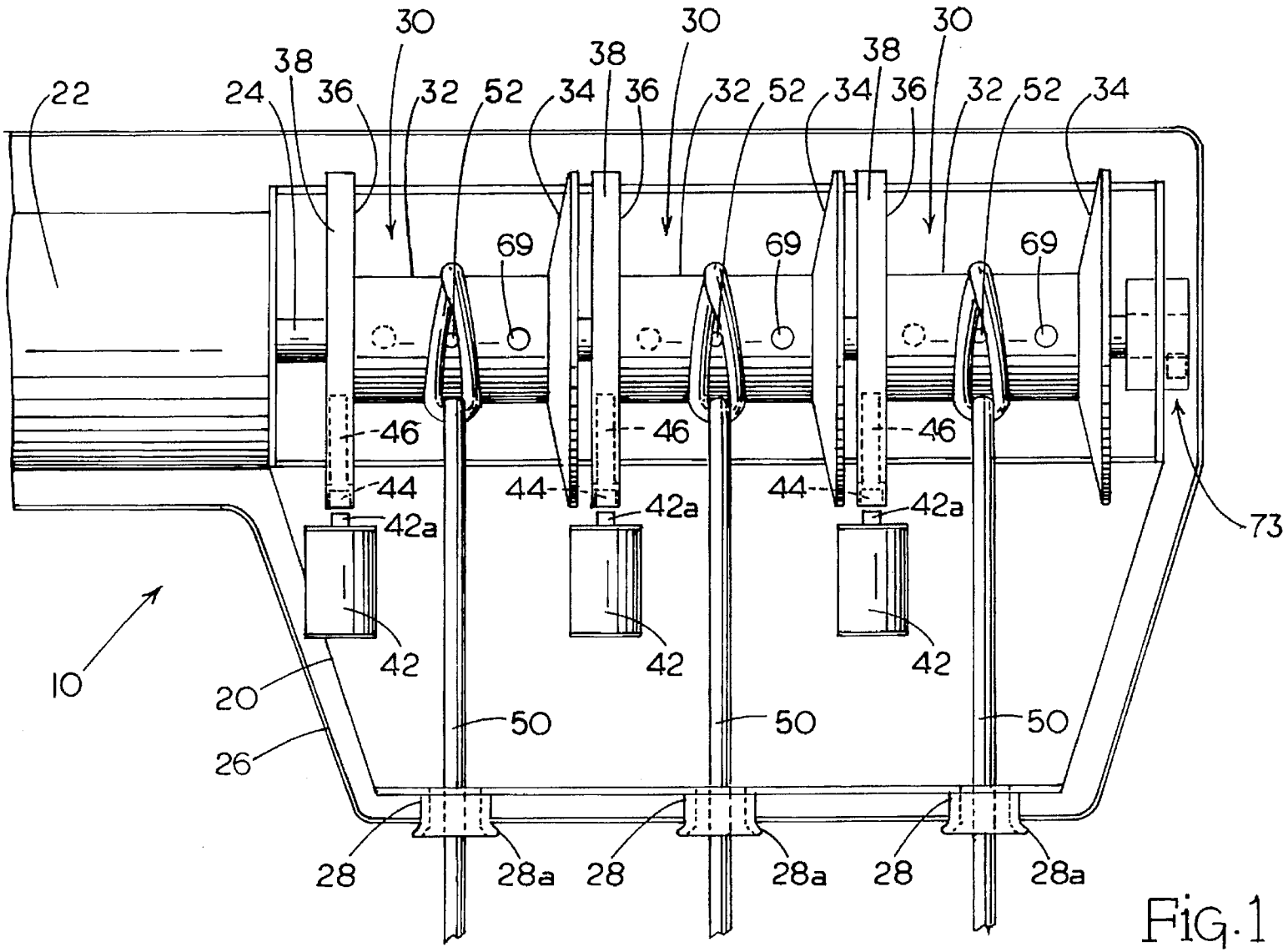
FIG. 1 is a top view of a preferred embodiment of the waterski tow rope retriever of the invention, shown here with three tow rope spools inside a housing.

The present invention is described more fully hereinafter by referring to the drawings, in which a preferred embodiment is depicted. However, the present invention can take on many different embodiments and is not intended to be limited to the embodiments described herein.

Referring now to the drawings, a waterski tow rope retriever, generally designated 10, is shown constructed according to the present invention for simultaneously towing one or more waterskiers behind a boat while being capable of independently reeling in individual tow ropes to avoid dangers inherent with waterskiing alongside a trailing, unattended tow rope that has been dropped by another skier. As seen in the drawings, the preferred embodiment of the waterski tow rope retriever 10 generally includes four components: a frame structure 20 for attachment to a waterski boat; a motor 22; a driveshaft 24 rotatably mounted in the frame and driven by the motor 22; and a plurality of tow rope spools 30 on the driveshaft 24 for storing, letting out, and reeling in waterski tow ropes 50.

Figure 2:
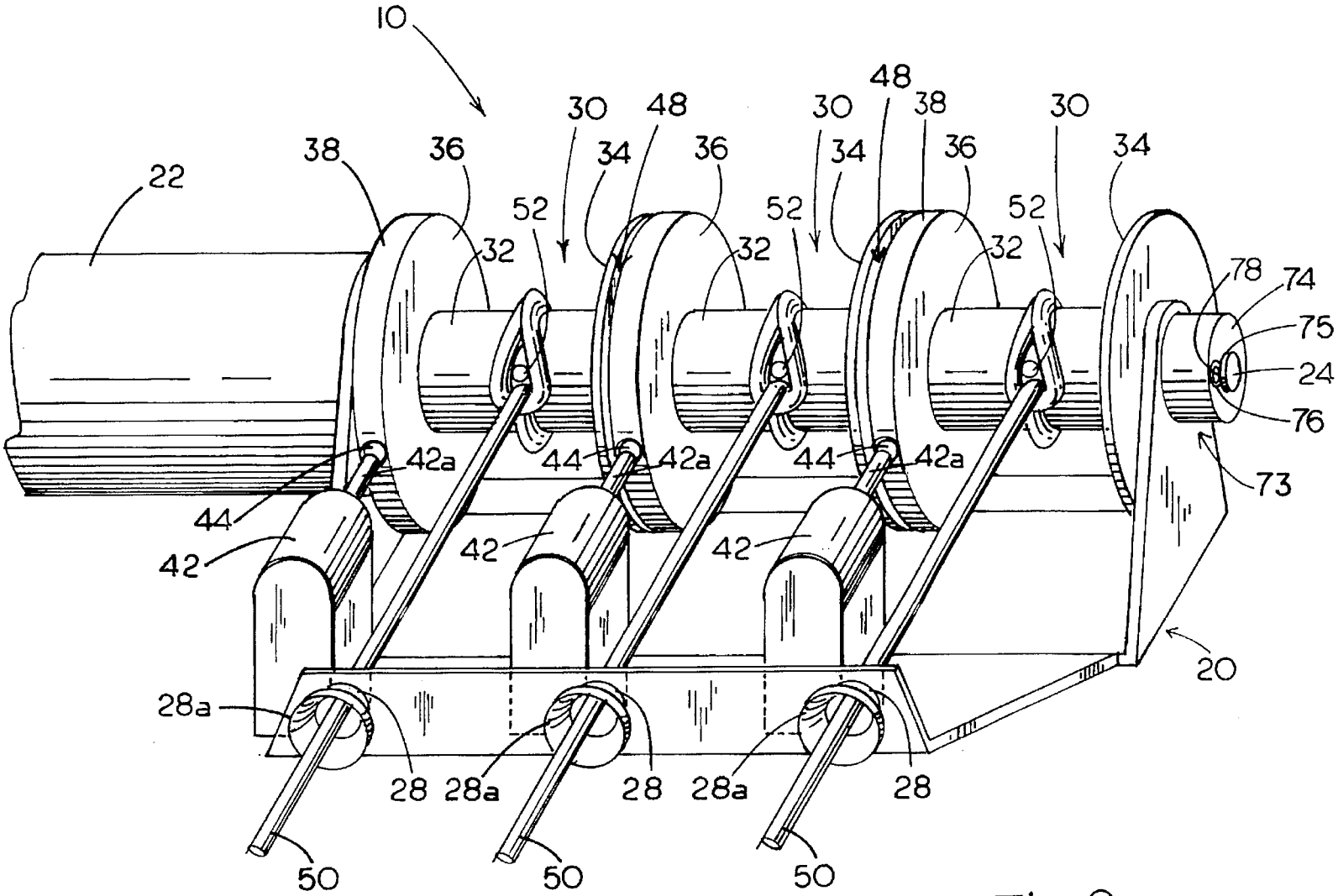
FIG. 2 is a perspective view of the waterski tow rope retriever of the invention, shown here without the housing.

The frame structure 20 supports all of the other components of the waterski tow rope retriever 10 and is preferably formed of a corrosion-resistant metal or other solid, durable material. The frame 20 is designed to be rigidly mounted either inboard within the back section of the ski boat or outboard on top of the back section of the ski boat. As shown in FIG. 1, the waterski tow rope retriever 10 preferably includes a housing 26, which encloses the frame 20 and the other components to protect them when the waterski tow rope retriever 10 is mounted outboard on the boat. When the waterski tow rope retriever 10 is mounted inboard, the housing 26 becomes unnecessary. FIG. 2 shows the waterski tow rope retriever 10 without the housing 26. To allow the waterski tow ropes 50 to extend through the housing 26, the housing 26 includes guide ports 28, one for each tow rope 50, through which the tow ropes 50 pass. As shown in FIG. 1, the guide ports 28 are preferably generally horn-shaped with outwardly widening flanges 28*a* to prevent the tow ropes 50 from snagging as they pass through the guide ports 28. In the case of an inboard-mounted waterski tow rope retriever 10 without a housing 26, such as that shown in FIG. 2, guide ports 28 may be disposed in the rear transom of the boat.

The motor 22 is shown in the drawings mounted to one end of the frame structure 20. Preferably, the motor 22 is a DC-powered 12-volt motor so that it can be powered by a conventional boat's electrical system. An automotive starter motor is suitable for use as the motor 22 of the waterski tow rope retriever 10. Like an automotive starter motor, the motor 22 utilizes a solenoid and is preferably powered directly from the battery of the boat. It is contemplated that a control switch for actuating and deactuating the waterski tow rope retriever 10 could be mounted near the other operational controls of the boat for easy access by the boat driver. In the preferred embodiment, the electrical system powering the motor 22 includes means for selectively operating the motor 22 at variable speeds. This may include one or more fixed resistors for allowing incremental motor speeds or a variable resistor for allowing continuously adjustable motor speed. Such electrical circuitry for powering and varying the speed of the motor 22 would be easily implemented by one skilled in the art.

Figure 4:
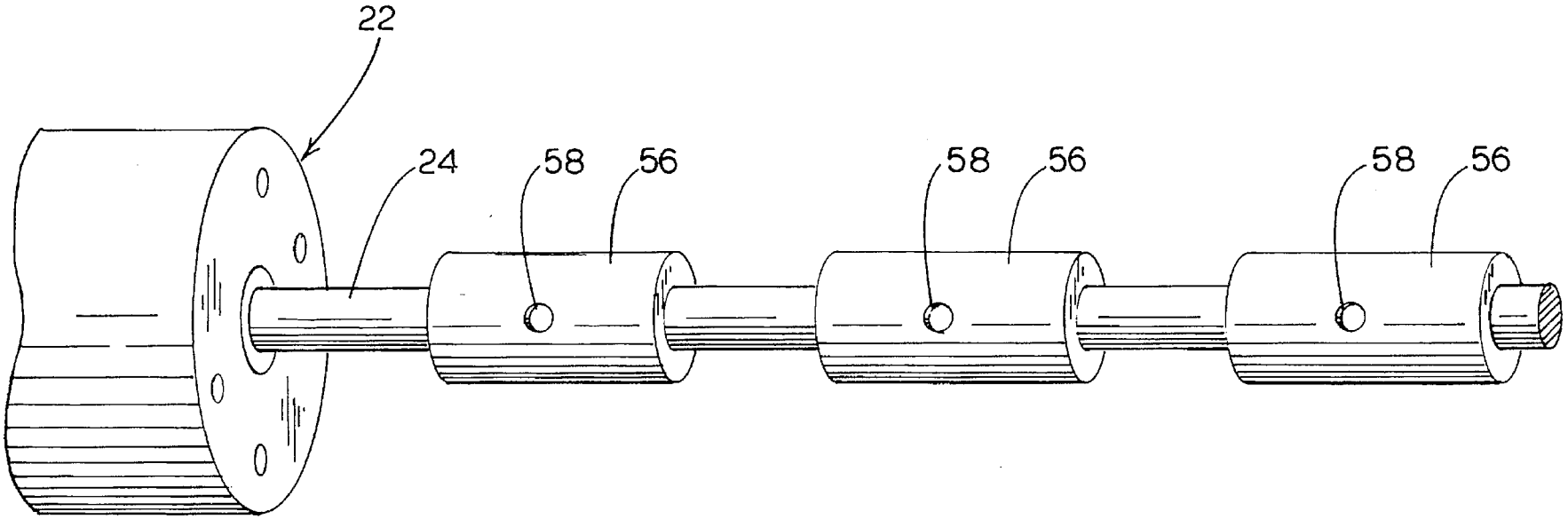
FIG. 4 is a perspective view of the motor, driveshaft, and attached sleeves, here seen with the tow rope spools removed.

The driveshaft 24 is rotatably mounted in the frame 20, preferably using bearings to ensure smooth and wear-free rotation. While the drawings (particularly FIG. 4) all show the driveshaft 24 being directly attached to the motor 22, extending from one end thereof, it is contemplated that the motor 22 could be operatively connected to the driveshaft 24 using other means. For example, it is envisioned that the motor 22 could be mounted behind the driveshaft 24 and spools 30 and operatively connected to the driveshaft 24 by a belt, chain, or gears. Such an arrangement would be advantageous if a particularly short and compact waterski tow rope retriever 10 were desired.

As shown in the drawings, the depicted embodiment of the waterski tow rope retriever 10 includes three tow rope spools 30, although any reasonable number of spools 30 could just as easily be provided. It is also contemplated that the waterski tow rope retriever 10 could be constructed with only a single spool 30. The maximum number of spools 30 is only limited by the width of the boat and the number of waterskiers a particular boat can pull.

Figure 5:
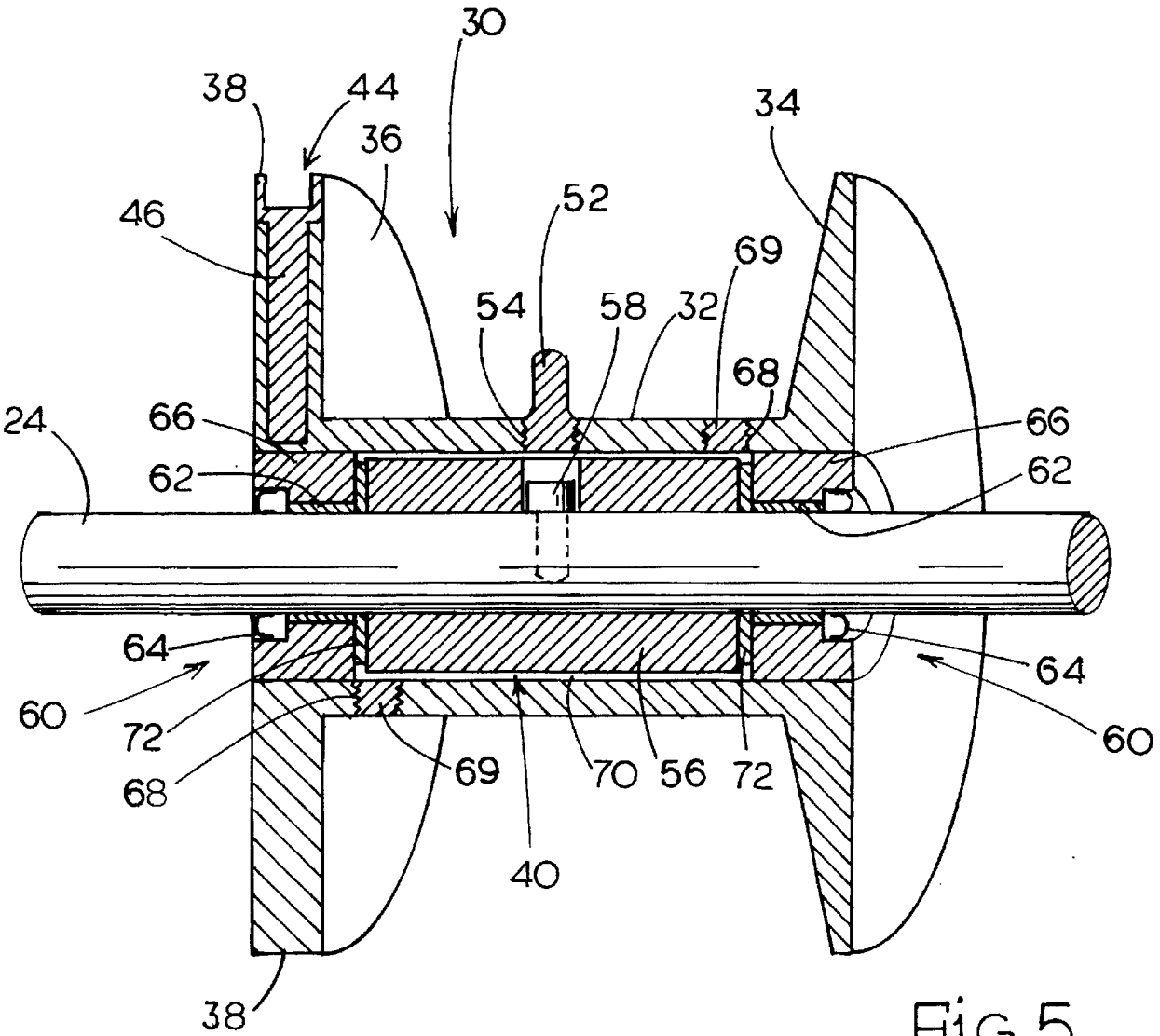
FIG. 5 is a perspective cross-section of one of the tow rope spools, which reveals the structure of the internal fluid drive.

As shown best in FIG. 5, each tow rope spool 30 generally includes three subcomponents: an central, generally cylindrical section 32 to which a waterski tow rope 50 is anchored and through which the driveshaft 24 longitudinally extends; a pair of flanges 34, 36 extending outwardly from opposite sides of the central cylinder 32, which form lateral barriers to maintain the tow rope 50 on the spool 30; and a fluid drive 40 within the spool 30 for transferring rotational force from the driveshaft 24 to the spool 30. While the following description will refer to only one spool 30, it should be understood that all of the spools 30, no matter what the number, are preferably identical to each other.

The spool's central cylindrical section 32 and flanges 34, 36 are preferably integrally formed from a durable material such as plastic or PVC or alternatively a corrosion-resistant metal. The central cylindrical section 32 and flanges may also be formed separately then bonded or welded together. The central cylinder 32 preferably includes a tow rope anchor 52 for preventing the tow rope 50 from slipping around the spool. The tow ropes 50 are preferably anchored to the spools 30 as shown in FIGS. 1 and 2. The tow rope anchor 52 is formed of a strong material such as stainless steel and preferably includes a threaded section for tightening the anchor 52 into a correspondingly threaded anchor hole 54 in the central cylinder 32. As will be better understood upon a further reading of this description, the anchor hole 54 is preferably wide enough to allow sleeve retaining screw 58 to be inserted or removed through the anchor hole 54 upon assembly or disassembly of the spool 30.

Unlike the friction clutches of the prior art ski rope reel apparatuses, the fluid drive 40 of the present invention does not use mechanical contact between two solid structures such as clutch shoes to transfer rotational force from the driveshaft 24 to the spool 30. Instead, the fluid drive 40 of the present invention transfers rotational power through a high-viscosity fluid, preferably STP OIL TREATMENT™, which is distributed by First Brands Corporation in Danbury, Conn. However, other fluids of sufficiently high viscosity to transfer rotational force from the driveshaft 24 to the spool 30 could be used instead of STP OIL TREATMENT™ such as heavyweight gear oil. Accordingly, the fluid drive 40 of the present invention preferably comprises a sealed internal void 70 within the central cylinder 32 and a volume of high-viscosity fluid disposed within the sealed internal void 70.

For maximum performance and power transference, the void 70 is completely filled with the high-viscosity fluid. Additionally, for maximum performance and power transference, the volume of high-viscosity fluid is minimized so that the surface-to-volume ratio is maximized. To achieve this volume reduction and corresponding surface-to-volume ratio maximization, the fluid drive 40 preferably includes a cylindrical sleeve 56 disposed around the driveshaft 24 within the internal void 70. This sleeve 56 may be formed of lightweight material such as plastic or PVC and is immovably secured to the driveshaft 24 using the aforementioned sleeve retaining screw 58, which is preferably accessible through the anchor hole 54 in the central cylinder 32. The outer surface of the sleeve 56 may be smooth, but preferably is textured to better agitate the high-viscosity fluid and therefore better transfer rotational force to the spool 30.

High-viscosity fluid is introduced into the void 70 through at least one access opening from the exterior of the spool 30 into the internal void 32. Each access opening includes an associated plug for sealingly closing the respective access opening. While the anchor hole 54 and tow rope anchor 52 may serve as the access opening and plug, respectively, for filling and emptying the internal void 70, the spool preferably includes two separate access openings 68 and associated plugs 69. Preferably, the plugs 69 are formed of strong material such as stainless steel and are designed to tighten flush with the outer surface of the central cylinder 32 so as not to fray or snag the attached tow rope 50 when it is wound around the spool 30. The two access openings 68 and plugs 69 are also preferably located on opposite ends and opposite sides of the central cylinder 32 from each other. The reason for this disposition is so that the internal void 70 can be bled free of trapped air bubbles when it is being filled with fluid. Like the anchor hole 54 and anchor 52, the access openings 68 and plugs 69 are preferably correspondingly threaded to ensure that no fluid leaks out of the void 70 when the plugs 69 are tightened.

To prevent the fluid from leaking out of the internal void 70 from the ends of the spool 30, each spool 30 includes a sealing assembly 60 at each end of the central cylinder 32 that closes off the internal void. Preferably, the sealing assembly 60 is a donut-shaped assembly occupying the space between the driveshaft 24 and an inner surface of the central cylinder 32. As shown best in FIG. 5, the sealing assembly 60 at each end of the spool 30 includes a bearing 62 around the driveshaft 24 for reducing friction and a donut-shaped end plug 66, preferably formed of plastic or PVC, which houses the bearing 62. An annular fluid seal 64 adjacent the bearing 62 prevents fluid leakage around the bearing 62. In an alternate embodiment, the end plug 66 at one end of the internal void could be integrally molded along with the rest of the spool and would not be a separate piece. However, the end plug 66 at the other end of the spool 30 would still need to be formed separately so that the spool could be installed on the driveshaft 24 around the sleeve 56.

Preferably, each spool 30 includes internal thrust washers 72 disposed around the driveshaft 24 immediately adjacent the sealing structures 60 inside the void 70 to prevent longitudinal movement of the spool 30 relative to the driveshaft 24 in either direction. In another alternative, the sleeve 56 could be formed slightly longer and perform the same function as the thrust washers 72.

As shown in the drawings, the spools 30 are completely self-contained in that all of their components are disposed between planes defined by the outer surfaces of the two flanges 34, 36 of each spool 30. This allows the spools 30 to be disposed side-by-side on the driveshaft 24 immediately adjacent to one another with no intervening structures. This is shown best in FIG. 5 by recognizing that the space 48 between adjacent spools only needs to be large enough so that the outer surfaces of the adjacent spool flanges 34 and 36 do not contact each other. One advantage of this self-containment and resulting adjacent spool spacing is that the entire waterski tow rope retriever 10 of the invention may be as compact as possible. There are no intervening clutch mechanisms between the spools, as is the case with the apparatus disclosed in the Jamieson patent. Thus, multiple spools 30 can be fit into limited space on a boat.

In operation of the waterski tow rope retriever 10 of the invention, it should be appreciated that with multiple spools 30, each with its own tow rope 50, the tow ropes 50 can be reeled in either simultaneously or individually. When the driveshaft 24 rotates, the fluid drives 40 cause the spools 30 to rotate with only enough force to reel in an unattended tow rope 50 after it has been released by a waterskier. The fluid drive 40 does not transfer enough power to reel in a waterskier. However, when a waterskier wishes to unreel a tow rope 50 from a respective one of the spools 30 as he/she begins skiing, the fluid drive 40 permits that spool 30 to rotate independently of the driveshaft 24 and the other spools 30 and thereby let out the respective waterski rope 50. If two or more waterskiers are skiing simultaneously behind the boat and one skier falls, the waterski tow rope retriever 10 of the invention can be activated to reel in the tow rope dropped by the fallen skier while the other skier or skiers continue to ski unaffected.

Upon consideration of the design of the present invention, it should become apparent that in addition to the fluid drive 40 of each spool 30 transferring rotational force from the driveshaft 24 to the spool 30, the reverse is also possible. Particularly if the motor 22 is not activated, a spool 30 that is being unwound as a skier is beginning to be towed will exert rotational force through the fluid drive 40 to the driveshaft, except in the opposite direction that the motor 22 and driveshaft 24 normally turn. The driveshaft's resulting rotation in the opposite direction will then transfer rotational force through the other fluid drives 40 to the other spools 30, also in the direction opposite from the normal direction that reels in the tow ropes 50. This rotation, if left unchecked, will cause the other tow ropes 50 to be unwound from the respective spools even though no waterskiers are using them. These unattended tow ropes 50 will then be left dangling in the water behind the boat.

Figure 3:
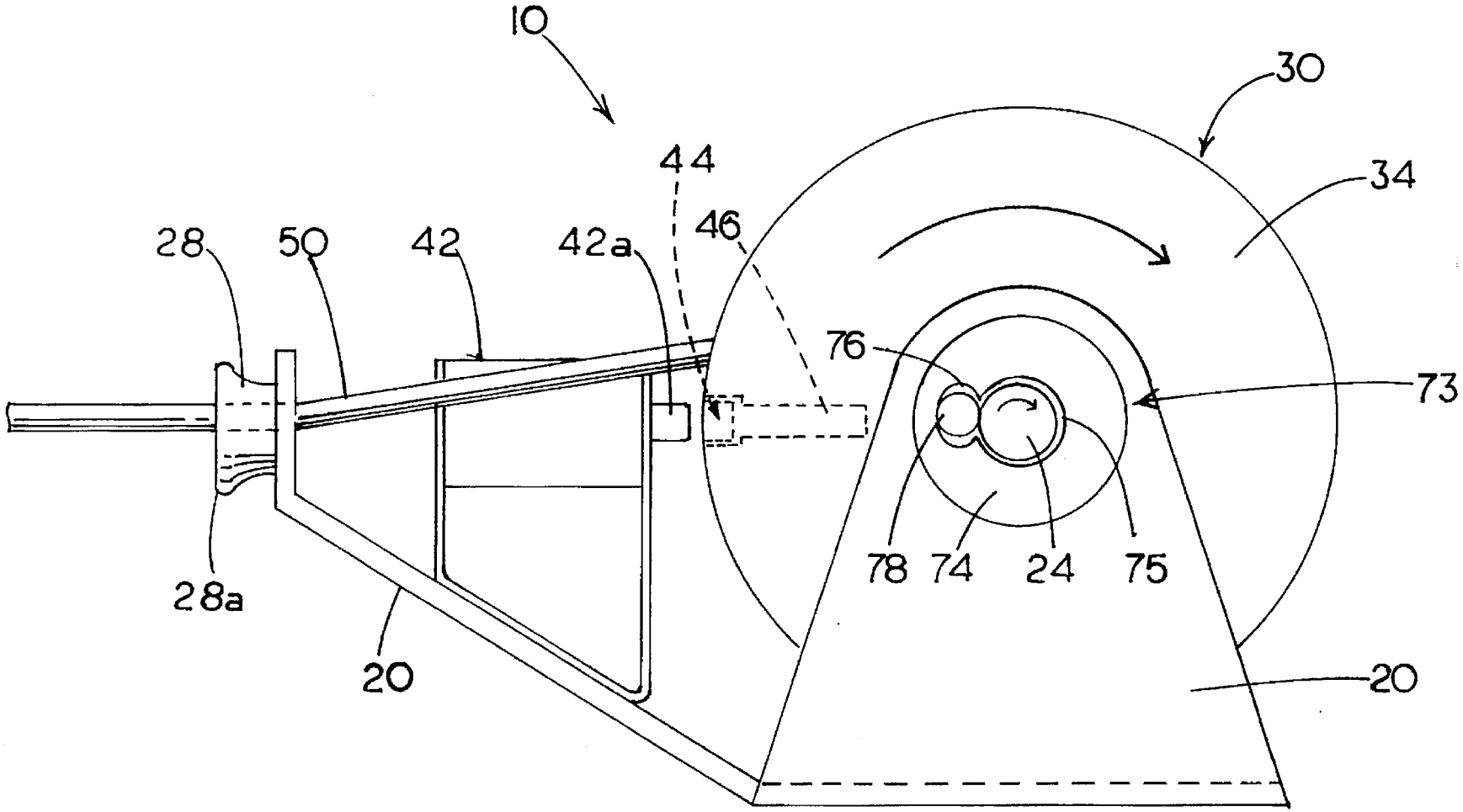
FIG. 3 is an end view of the driveshaft of the waterski tow rope retriever, which depicts the anti-reverse mechanism that allows only unidirectional rotation of the driveshaft.

To prevent this problem of unwanted tow rope unwinding, the driveshaft 24 is designed to be unidirectional so that it rotates only in the direction that reels in the tow ropes 50. To achieve this, the waterski tow rope retriever 10 of the invention preferably includes an anti-reverse mechanism 73 associated with the driveshaft 24. As shown best in FIG. 3, the anti-reverse mechanism 73 preferably includes a collar 74 attached to the frame structure 20, preferably on the end opposite the motor 22. The collar 74 includes a central void 75 in which the driveshaft 24 is disposed. A secondary void 76 communicates with the central void 75 and holds an anti-reverse roller 78 that engages the driveshaft 24 to permit rotation of the driveshaft 24 in only the direction that reels in the tow ropes 50. Although the anti-reverse mechanism 73 is preferably as described herein, other structures that permit only one direction of driveshaft rotation could also be used.

As the fluid drive 40 does not transfer enough rotational power to a spool 30 to reel in a waterskier, it also cannot be used to keep a tow rope 50 from being let all the way out to its full length. However, waterskiers often desire to ski at different distances behind the boat and do not wish for the tow rope 50 to be let all the way out. Therefore, the waterski tow rope retriever 10 of the invention includes a spool locking device associated with the spools 30, which is operative to engage the spools 30 to prevent them from rotating, thereby allowing less than full lengths of the tow ropes 50 to be let out to tow waterskiers.

The spool locking device preferably includes a locking solenoid 42 associated with each spool 30. As shown in the drawings, the locking solenoids 42 are preferably rigidly mounted to the frame structure 20. Each locking solenoid 42 includes a locking pin **42*a* that upon operation of the solenoid 42 extends into a hole 44 in an outer edge of one of the spool flanges to thereby prevent that spool 30 from rotating. The locking solenoids 42 may be operative as a unit, whereby all of the spools 30 are locked together, or may be operative individually so that the tow ropes 50 can each be individually let out to any desired length. The electrical system for operating the locking solenoids 42**, either individually or as a unit, should be understood by one skilled in the art and will not, therefore, be described in detail. However, it is preferable that the locking solenoid controls be located in the boat for easy access by the driver.

As seen in the drawings, at least one of the spool flanges includes a relatively wide outer edge 38 with the hole 44 extending into the respective flange from the relatively wide outer edge 38. In the drawings, flange 36 includes the relatively wide edge 38, whereas flange 34 tapers to a relatively narrow edge. However, both flanges could include wide edges if desired for uniformity. Although only one hole 44 per wide flange edge 38 is shown in the drawings, a plurality of holes 44 could be provided for greater adjustability of the tow rope length. The holes 44 can be formed directly into the material of the flange 36 if desired. However, with the preferred embodiment of the invention, wherein the spools 30 are molded of plastic or PVC, the hole is preferably formed in a metal locking sleeve 46, which is in turn embedded in the flange 36. FIG. 5 shows the locking sleeve 46 shown in cross section within the wide flange 36.

The waterski tow rope retriever 10 of the present invention achieves the above-stated objects and overcomes the disadvantages of prior art tow rope reel apparatuses. For example, the present invention overcomes the disadvantages of the Jamieson and Weide apparatuses with their friction clutches by providing the fluid drive of the present invention. Whereas the friction clutch components of the Jamieson apparatus are susceptible to wetness and wear, both of which can lead to failure of the apparatus, the internal fluid drive of the present invention is practically impervious to such problems. Just as the clutch fluid is sealed within the spools, water is sealed out. Water therefore has no effect on the operation of the tow rope spools of the present invention. In addition, there are comparatively few mechanical parts to wear out in the spools of the present invention. There are no mechanical friction contact surfaces other than the bearings, which are designed to reduce friction, and the thrust washers. Whereas the friction clutch design of Jamieson by its very nature leads to friction and wear, the fluid drive design of the present invention avoids wear by continuously lubricating all moving parts, such as the bearings and thrust washers, with the same fluid that transfers the rotational power from the driveshaft to the spool. In other words, the high-viscosity STP OIL TREATMENT™ or gear oil serves as a constant source of lubrication inside the spools in addition to performing its function of transferring rotational power.

The waterski tow rope retriever 10 of the present invention is particularly useful when towing beginning waterskiers, because, as mentioned above, very little pull is required to unreel the tow rope 50 from one of the spools 30. All of the prior art tow rope reel apparatuses having friction clutches must necessarily employ enough clutch tension to overcome the drag of the water when a tow rope is being reeled in. If this water drag equals, for example, ten pounds of pull, at least ten pounds of pull must be exerted to reel in the tow rope through the water. Therefore, it will also take at least ten pounds of pull from a waterskier to break the grip of the friction clutch and begin unreeling the tow rope. Therein lies a particularly great advantage of the present invention. When the driveshaft 24 is not turning, practically no force must be exerted to unreel the tow rope 50 from the reel 30. The fluid drive means 40 allows almost effortless unreeling of the tow ropes at the beginning of a ski run. This makes for easier learning when beginning skiers must use all of their concentration to stand up in the water and do not need to be burdened with simultaneously unreeling a tow rope held tightly by a friction clutch. With the present invention, enough force to overcome water drag and reel in the tow rope is not exerted until the motor is turned on and run at relatively high RPM's; however, this does not occur when the waterskier is first getting up in the water.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A waterski tow rope retriever, comprising:

a) a frame for attachment to a rear section of a waterski boat;

b) a driveshaft rotatably mounted in said frame;

c) a motor operatively connected to said driveshaft;

d) at least one spool for storing, letting out, and reeling in a waterski tow rope attached to each said at least one spool;

e) a fluid drive associated with said at least one spool for transferring rotational power from said driveshaft to said spool;

f) whereby, when said driveshaft rotates, said fluid drive causes said spool to rotate with enough force to reel in the waterski tow rope after it has been released by a waterskier; and g) whereby, when said driveshaft does not rotate, said fluid drive permits said spool to rotate independently of said driveshaft and thereby let out the waterski tow rope with little effort when a waterskier pulls on the waterski tow rope.

2. The waterski tow rope retriever according to claim 1, comprising a plurality of spools, each spool having an anchored waterski tow rope so that multiple waterskiers can be towed behind the waterski boat.

3. The waterski tow rope retriever according to claim 2, wherein said plurality of spools are disposed side-by-side around said driveshaft immediately adjacent to one another.

4. The waterski tow rope retriever according to claim 2, further comprising a housing that encloses said spools, said housing including a plurality of waterski tow rope guide ports through which pass the waterski ropes.

5. The waterski tow rope retriever according to claim 2, further comprising a spool locking device associated with each said spool, said spool locking devices operative to engage respective spools to prevent the spools from rotating, thereby allowing less than full lengths of waterski tow rope to be let out to tow waterskiers.

6. The waterski tow rope retriever according to claim 5, wherein said spool locking devices are individually operative so that the waterski tow ropes can each be individually let out to any desired length.

7. The waterski tow rope retriever according to claim 1, wherein said motor is selectively operative to rotate said driveshaft at variable speeds.

8. The waterski tow rope retriever according to claim 1, wherein said driveshaft is unidirectional, rotating only in a direction that reels in the tow rope.

9. The waterski tow rope retriever according to claim 8, further comprising an anti-reverse mechanism associated with said driveshaft, said anti-reverse mechanism including: a collar attached to said frame, said collar including a primary void in which is disposed said driveshaft and a secondary void communicating with said primary void; and an anti-reverse roller disposed in said secondary void for engaging said driveshaft to permit rotation of said driveshaft in only one direction.

10. A waterski tow rope spool for a waterski tow rope retriever that includes a frame for attachment to a waterski boat and a motor-driven driveshaft rotatably mounted in the frame for rotating said waterski tow rope spool, said waterski tow rope spool comprising:

a) a central cylinder to which a waterski tow rope is anchored, said driveshaft extending longitudinally through said cylinder;

b) a pair of flanges extending outwardly from opposite ends of said central cylinder, said flanges forming lateral barriers to maintain the waterski tow rope on said spool; and c) a fluid drive for transferring rotational force from the driveshaft to said spool, said fluid drive including:

i) a sealed internal void within said central cylinder surrounding the driveshaft, and ii) a volume of fluid disposed within said internal void, said fluid of sufficiently high viscosity to transfer rotational force from the driveshaft to said spool;

whereby, when the driveshaft rotates, said fluid drive causes said spool to rotate with enough force to reel in the waterski tow rope after it has been released by a waterskier; however, when a waterskier wishes to unreel the waterski tow rope from said spool, said fluid drive permits said spool to rotate independently of the driveshaft and thereby let out the waterski tow rope.

11. The waterski tow rope spool according to claim 10, wherein said fluid comprises high viscosity oil.

12. The waterski tow rope spool according to claim 10, wherein said fluid drive further includes a sleeve immovably disposed around the driveshaft within said internal void within said central cylinder.

13. The waterski tow rope spool according to claim 10, further comprising a sealing assembly at each end of said cylinder around the driveshaft, each said sealing assembly including a bearing around the driveshaft for reducing friction and an annular seal adjacent said bearing for preventing said fluid from leaking out of said internal void.

14. The waterski tow rope spool according to claim 10, further comprising a pair of thrust washers disposed around the driveshaft for preventing longitudinal movement of said spool relative to the driveshaft in either direction.

15. The waterski tow rope spool according to claim 10, wherein said central cylinder includes at least one access opening into said internal void for filling and emptying said internal void with said fluid, each said at least one access opening including an associated plug for closing the respective access opening.

16. The waterski tow rope spool according to claim 15, wherein there are two access openings in said central cylinder, said two access openings disposed on opposite ends and opposite sides of said central cylinder from one another.

17. The waterski tow rope spool according to claim 10, wherein at least one of said flanges includes a relatively wide outer edge with a hole extending into the respective flange from said relatively wide outer edge; and wherein said waterski tow rope spool further comprises a locking solenoid associated with said spool, said locking solenoid including a locking pin that is operative to extend into said hole to thereby prevent said spool from rotating.

18. The waterski tow rope spool according to claim 10, wherein all components of said spool are disposed between two planes defined by outer surfaces of said two flanges, thereby allowing a plurality of like spools to be disposed on the driveshaft immediately adjacent to one another.

19. A multiple waterski tow rope retriever, comprising:

a) a frame for attachment to a rear section of a waterski boat;

b) a driveshaft rotatably mounted in said frame;

c) a motor operatively connected to said driveshaft for rotating said driveshaft;

d) a plurality of spools disposed around said driveshaft immediately adjacent to one another for storing, letting out, and reeling in a plurality of waterski tow ropes, each tow rope attached to one of said spools, each said spool including:

i) a central cylinder to which one of the waterski tow ropes is anchored, said driveshaft extending longitudinally through said cylinder, and ii) a pair of flanges extending outwardly from opposite ends of said central cylinder, said flanges forming lateral barriers to maintain the waterski tow rope on said spool; and e) fluid drive means associated with said spools for transferring rotational force from said driveshaft to said spools, said fluid drive means including:

i) an internal void within each said central cylinder surrounding said driveshaft, ii) a sleeve within each said internal void immovably disposed around said driveshaft, iii) sealing means for sealingly enclosing the internal void within each said central cylinder, and iv) a relatively high viscosity fluid disposed within the internal void within each said central cylinder;

whereby, when said driveshaft rotates, said fluid drive means causes said spools to rotate with only enough force to reel in the waterski tow ropes after they have been released by waterskiers; however, when a waterskier wishes to unreel a waterski rope from a respective one of said spools, said fluid drive means permits the respective spool to rotate independently of the driveshaft and the other spools and thereby let out the respective waterski rope.

20. The multiple waterski tow rope retriever according to claim 19, wherein at least one of said flanges of each said spool includes a relatively wide outer edge with a hole extending into the respective flange from said relatively wide outer edge; wherein said multiple waterski tow rope retriever further comprises a plurality of spool locking solenoids attached to said frame, one spool locking solenoid associated with each said spool; and wherein said spool locking solenoids are operative to engage respective spools to prevent the respective spools from rotating, thereby allowing less than full lengths of waterski tow rope to be let out from the respective spools to tow waterskiers.

* * * * *